United States Patent [19]

Puckett

[11] 4,218,787

[45] Aug. 26, 1980

[54] PORTABLE SPITTOON

[76] Inventor: Stanley M. Puckett, Box 371, King St., North Tazewell, Va. 24630

[21] Appl. No.: 920,734

[22] Filed: Jun. 30, 1978

[51] Int. Cl.[3] ..... A61J 19/00

[52] U.S. Cl. ..... 4/258; 4/274

[58] Field of Search ..... 4/258, 259, 274, 1, 4/144.1; 128/295

[56] References Cited

U.S. PATENT DOCUMENTS

| | | | |
|---|---|---|---|
| 1,219,152 | 3/1917 | Raid et al. | 4/274 |
| 1,698,085 | 1/1929 | Crozier | 4/258 |
| 3,155,990 | 11/1964 | Templeton | 4/258 |
| 3,259,920 | 7/1966 | Voller | 4/144.1 |
| 3,422,463 | 1/1969 | Lowery | 4/144.1 |

*Primary Examiner*—Henry K. Artis

*Attorney, Agent, or Firm*—Daniel Jay Tick

[57] ABSTRACT

A liquid-tight container has a hole formed through the top. An opening formed through the container in spaced relation with the hole is selectively covered by a closable cover. A belt clip affixed to the back of the container removably affixes the container to a belt worn by a user. A hose is affixed at one end to the top of the container at the hole therethrough and opens into the container. A funnel is affixed to the hose at the opposite end thereof and opens into the hose whereby the user may expectorate into the container via the funnel and the hose.

2 Claims, 4 Drawing Figures

PORTABLE SPITTOON

BACKGROUND OF THE INVENTION

The present invention relates to a portable spittoon.

Portable spittoons are disclosed in the following United States patents. U.S. Pat. No. 630,225, issued Aug. 1, 1899 to Hodgerney, U.S. Pat. No. 1,103,832, issued July 14, 1914 to Rackoff, U.S. Pat. No. 1,232,957, issued July 10, 1917 to Mullestein, U.S. Pat. No. 1,344,442, issued July 22, 1920 to Colestock, U.S. Pat. No. 1,726,271, issued Aug. 27, 1929 to Lange et al and U.S. Pat. No. 2,965,907, issued Dec. 27, 1960 to Ropelato.

Objects of the invention are to provide a portable spitton of simple structure, which is inexpensive in manufacture, used with facility and convenience, carried with facility and convenience on the belt of a user, and functions efficiently, effectively and reliably to collect any material expectorated by the user thereby preventing pollution of the area traversed by the user.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 3:
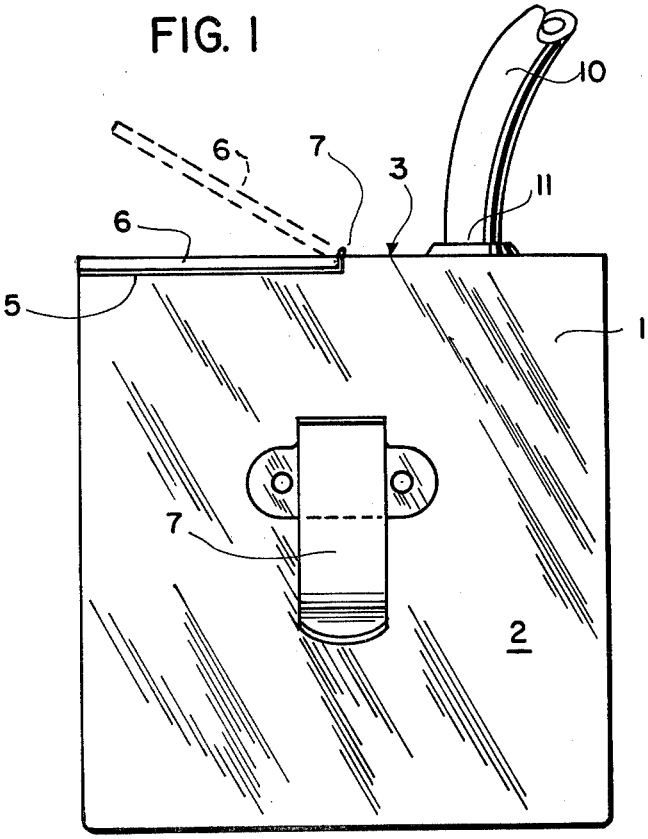
FIG. 3 is a rear view, on an enlarged scale, of the container of the portable spittoon of the invention.
Figure 4:
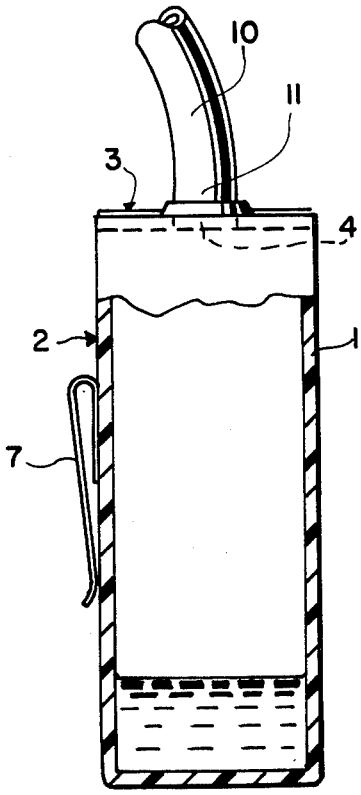
FIG. 4 is a view, on an enlarged scale, partly cutaway and partly in section of the container of FIG. 3.

The portable spittoon of the invention comprises a liquid-tight container 1 (FIGS. 1, 3, and 4) having a back 2 (FIGS. 3 and 4) and a top 3 extending substantially perpendicularly to said back, as shown in FIGS. 3 and 4. The top 3 has a hole 4 formed therethrough (FIG. 4). An opening 5 (FIG. 3) is formed through the top 3 of the container 1 in spaced relation with the hole 4 (FIG. 3). A closable cover 6 (FIGS. 1 and 3) is hingedly affixed to the top 3 by any suitable hinge such as, for example, a hinge 7 (FIG. 3), affixed thereto for selectively covering the opening 5.

Figure 1:
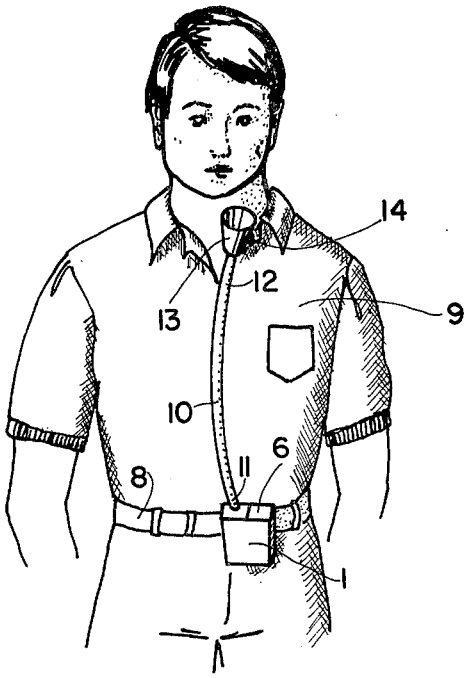
FIG. 1 is a perspective view of an embodiment of the portable spittoon of the invention, in use.

A belt clip 7 (FIGS. 3 and 4) is affixed to the back 2 of the container 1 for removably affixing the container to a belt 8 (FIG. 1) worn by a user 9 (FIG. 1).

Figure 2:
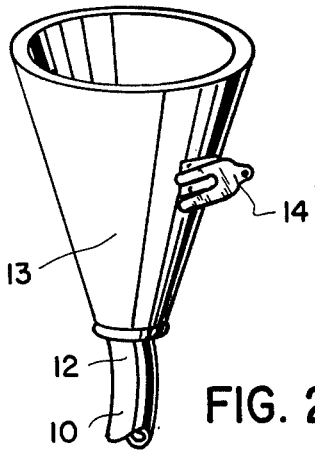
FIG. 2 is a perspective view, on an enlarged scale, of the funnel of the portable spittoon of the invention.

A hose 10 has spaced opposite first and second ends 11 (FIGS. 1, 3 and 4) and 12 (FIGS. 1 and 2), respectively. The hose 10 is affixed at its first end 11 to the top 3 of the container 1 at the hole 4 through said top and opens into said container.

A funnel 13 (FIGS. 1 and 2) is affixed to the hose 10 at the second end 12 of said hose and opens into said hose. The user 9 may thus expectorate into the container 1 via the funnel 13 and the hose 10. This is accomplished by the user either holding the funnel or by clipping the funnel to his shirt, as shown in FIG. 1.

In order to facilitate clipping the funnel 13 to the shirt or other garment of the user 9, an additional belt clip 14 (FIGS. 1 and 2) is affixed to the funnel. The additional belt clip 14 enables the funnel 13 to be removably supported on a garment worn by the user 9 when the spittoon is in use and to be removably supported on the belt 8 of the user 9 when the spittoon is not in use.

While the invention has been described by means of a specific example and in a specific embodiment, I do not wish to be limited thereto, for obvious modifications will occur to those skilled in the art without departing from the spirit and scope of the invention.

I claim:

1. A portable spittoon, comprising a liquid-tight container having a back and a top extending substantially perpendicularly to the back, said top having a hole formed therethrough, an opening formed therethrough in spaced relation with the hole and a closable cover hingedly affixed thereto for selectively covering said opening;

a belt clip affixed to the back of the container for removably affixing the container to a belt worn by a user;

a hose having spaced opposite first and second ends, said hose being affixed at its first end to the top of the container at the hole therethrough and opening into said container; and a funnel affixed to said hose at the second end of said hose and opening into said hose whereby the user may expectorate into said container via said funnel and said hose.

2. A portable spittoon as claimed in claim 1, further comprising an additional belt clip affixed to said funnel for removably supporting said funnel on a garment worn by a user.

* * * * *